United States Patent [19]

Yamazaki

[11] Patent Number: 4,729,937

[45] Date of Patent: Mar. 8, 1988

[54] LAYERED AMORPHOUS SILICON ELECTROPHOTOGRAPHIC PHOTOSENSITIVE MEMBER COMPRISES BN SURFACE LAYER AND BN BARRIER LAYER

[75] Inventor: Mutsuki Yamazaki, Yokohama, Japan

[73] Assignee: Kabushiki Kaisha Toshiba, Kawasaki, Japan

[21] Appl. No.: 943,190

[22] Filed: Dec. 18, 1986

[30] Foreign Application Priority Data

Dec. 26, 1985 [JP] Japan ..... 60-291866
Feb. 24, 1986 [JP] Japan ..... 61-38792

[51] Int. Cl.[4] ..... G03G 5/14
[52] U.S. Cl. ..... 430/65; 430/66
[58] Field of Search ..... 430/66, 65

[56] References Cited

U.S. PATENT DOCUMENTS 4,600,672 7/1986 Fujimura et al. ..... 430/84 X
4,624,905 11/1986 Haku et al. ..... 430/65

FOREIGN PATENT DOCUMENTS 59-12448 1/1984 Japan .

*Primary Examiner*—J. David Welsh
*Attorney, Agent, or Firm*—Schwartz, Jeffery, Schwaab, Mack, Blumenthal & Evans

[57] ABSTRACT

An electrophotographic photosensitive member wherein a photoconductive layer prepared from amorphous silicon is interposed between a barrier layer and surface layer, both prepared from boron nitride, and which is characterized in that it has a high specific resistivity, and, when applied as a barrier layer, indicates a high charge retention capability, strains in said barrier layer are reduced, the surface layer absorbs very little light and allows for the permeation of the greater part of the incoming light rays, thus preventing the photosensitivity of a photoconductive layer and the residual potential from being deteriorated, and since the concentration of boron varies in the boundary of the respective layer across their thickness, the photoconductive property can be sustained and the exfoliation of the layers can be avoided.

18 Claims, 2 Drawing Figures

LAYERED AMORPHOUS SILICON ELECTROPHOTOGRAPHIC PHOTOSENSITIVE MEMBER COMPRISES BN SURFACE LAYER AND BN BARRIER LAYER

BACKGROUND OF THE INVENTION

This invention relates to an electrophotographic photosensitive member sensitive to light rays (for example, electromagnetic waves such as ultraviolet rays, visible rays, infrared rays, X-rays, and gamma rays).

An electrophotographic photosensitive member has its surface, for example, positively charged by means of corona discharge. When light is irradiated on the surface of said photosensitive member with a predetermined pattern, pairs of electrons and holes are produced in that region of the photoconductive layer which has been irradiated by light, thereby neutralizing the surface charge by said electrons. Hole carriers travel through the photoconductive layer to a conductive support. On the other hand, that portion of the photosensitive member which was not irradiated by light retains a positive charge. As a result, an electrostatic latent image is formed by a positive charge. When a toner is statically adsorbed to the surface of said photosensitive member from a developer, the latent image produced in the surface of said photosensitive member is rendered visible. In this case, developing bias voltage is impressed on an area defined between the photosensitive member and developer to produce an electric field acting in an opposite direction to that in which an electric field produced by the electric charge of the surface of the photosensitive member.

The above-mentioned electrophotographic photosensitive member should have the features that the electric charge resulting from the corona discharge is sustained until development is performed after the irradiation of light rays, that is, the subject photosensitive member has a light charge-retaining capacity. Moreover, the carrier pair generated by light irradiation should be prevented from being bonded together once more and one of said pair acts to neutralize the surface charge of the photosensitive member and the other is quickly transmitted to the conductive support. Namely, the carrier should have a long life and be featured by its satisfactory traveling property.

An electrophotographic photosensitive member which should have the above-mentioned properties has hitherto been prepared from a material of amorphous chalcogenide series, for example, Se. Though able to occupy a large area, this amorphous chalcogenide material has the drawback that since the end portion of a light-absorbing region is positioned near the ultraviolet ray region involved in the visible rays, said amorphous chalcogenide has a low photosensitivity to the visible light rays and long wave light rays, and moreover, has a short life due to its low hardness.

On the other hand, amorphous silicon (as used herein, abbreviated as "a - Si") indeed has the merits that it can absorb light rays having a broad range of wavelengths so that it has a high light sensitivity over a broad range of wavelengths. Moreover, a - Si is featured by a long life due to its great hardness. In addition, a - Si does not adversely affect the human body during manufacture and can be produced in a large area at low cost. Recently, therefore, a - Si has received wide attention as a desirable material for an electrophotographic photosensitive member. Yet, a - Si still has the drawbacks that it generally has a specific resistivity as low as $10^8$ to $10^{10}$ Ωcm, in the dark, (hereinafter referred to as "dark resistivity"), and moreover, has a low charge retention capability.

To avoid the above-mentioned shortcomings, the conventional practice is to interpose an insulation layer of, for example, silicon nitride or silicon oxide or set up a barrier consisting of p-type or n-type a - Si between the conductive substrate and photoconductive layer of the photosensitive member, thereby to prevent carriers from being introduced from the conductive substrate into the photoconductive layer. If, in this case, a positive charge is handled, the barrier is prepared from p-type a - Si in order to allow for the passage of holes alone. If a negative charge is handled. The harrier is formed of n-type a - Si. Further, a surface layer is deposited on the photoconductive layer in order to raise the surface potential of the photosensitive member. Said surface layer is generally prepared from insulative material having a high specific resistivity.

Where, however, a thick insulative layer is applied to the surface of the photoconductive layer, the carrier transmitted from the photoconductive layer to the conductive substrate is obstructed in its travel, thus undesirably resulting in a high residual potential. If conversely a thin insulation layer is applied, a dielectric breakdown tends to occur due to the bias of development.

Further, if it is attempted to form p-type a - Si, it is necessary to dope an element belonging to Group III of the periodic table in a - Si. If it is attempted to form n-type a - Si, it is necessary to dope an element belonging to Group V of the periodic table in a - Si. However, the addition of an impurity causes noticeable strains to be produced in the a - Si layer. When, therefore, a photoconductive layer is deposited on the a - Si layer, noticeable differences appear in the strain of the respective layers. This tends to give rise to the foliation of the layers.

Where the surface layer of the photoconductive layer is prepared from insulative material, the photosensitivity of the resultant product will drop, because carriers travel at a slow speed, and the residual potential is raised. Consequently the thickness of the surface layer should generally be limited to 50 to 1000 Å. However, the surface layer preferably has great thickness in order to ensure a chemical stability against any charge in the condition of the atmosphere in which the photosensitive member is applied.

SUMMARY OF THE INVENTION

It is the object of the invention to provide an electrophotographic photosensitive member which can be easily charged, has a high charge-retention capability, has a low residual potential, and is free from dielectric breakdown and the exfoliation of the constituent layers, and has a high light sensitivity over a broad range extending from ultraviolet rays to near-infrared rays, and has a long effective life.

To obtain the above-mentioned object, the present invention provides an electrophotographic photosensitive member which comprises:

a substrate;

a photoconductive layer comprising amorphous silicon;

a barrier layer, provided between said substrate and said photoconductive layer, for substantially inhibiting injection of carriers from said substrate to said photoconductive layer; and a covering layer provided on said photoconductive layer, said barrier layer and said covering layer comprising boron nitride.

In the above-mentioned case, boron may be added to the photo-conductive layer. Further, it is preferred that the concentration of boron be varied in a boundary between the barrier layer and photoconductive layer and/or in a boundary between the photoconductive layer and surface layer.

The electrophotographic photosensitive member embodying the present invention offers the advantages that the boron nitride (BN) constituting a barrier layer has a high specific resistance and a great charge retention capability, and minimizes strains occurring in the barrier layer. The surface layer is also prepared from boron nitride (BN). When applied as a surface layer, the BN material absorbs a very small amount of light rays and allows for the permeation of the greater part of the incoming light rays, and consequently prevents the deterioration of the photosensitivity of the photoconductive layer and the residual potential. The photoconductive layer prepared from a - Si has a high photosensitivity to light rays having a broad range of wavelengths and when the concentration of nitrogen N or boron B in the interface between the constituent layers varies in the direction of the layer thickness, the photoconductive property can be sustained and the exfoliation of the constituent layers can be prevented; the charging capacity and charge-sustaining capacity are noticeably improved; the residual potential is minimized; the dielectric breakdown and the exfoliation of the constituent layer are prevented; light rays having a broad range of wavelengths, from ultraviolet rays to near-infrared rays, can be detected with a high sensitivity; and the subject electrophotographic photosensitive member has a long effective life.

DETAILED DESCRIPTION OF THE PREFERRED EMBODIMENTS

Figure 1:
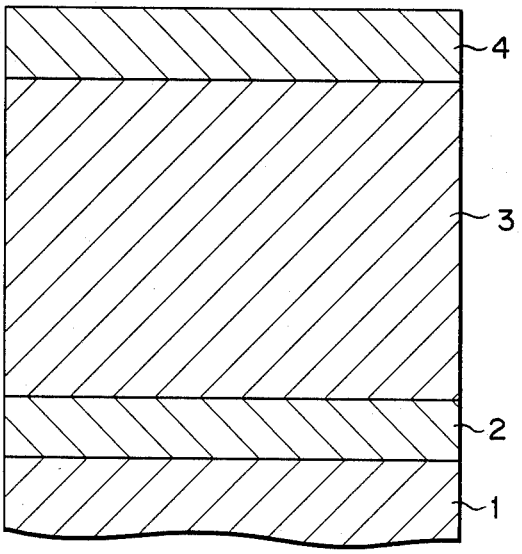
FIG. 1 is a partial sectional view of an electrophotographic photosensitive member embodying the present invention.

Description may now be made of an electrophotographic photosensitive member with reference to the attached drawings. FIG. 1 is a partial sectional view of the subject electrophotographic photosensitive member. Drum-shaped conductive substrate 1 may be prepared from aluminum or stainless steel or may be constructed by depositing a conductive or semiconductive material on the surface of a glass plate or a highmolecular film.

Barrier layer 2 is provided on said conductive substrate 1. This barrier layer 2 is prepared from boron nitride (BN). This boron nitride, closely resembling an intrinsic semiconductor, not only has a high specific resistivity but also has a very low strain in the layer. This BN layer 2 contains 5 to 200, or preferably 10 to 100 atomic % of nitrogen N, and 1 to 50 atomic % of hydrogen H or any of the halogen elements. It is preferred that said BN barrier layer 2 be deposited with a thickness of 50 Å to 5 microns or preferably 0.1 to 1 micron, because this process can not only elevate the charging capability, but also reduce residual potential.

Photoconductive layer 3 is deposited on said barrier layer 2. Said photoconductive layer 3 is prepared from amorphous silicon (hereinafter referred to as "a - Si") containing boron B. Said photoconductive layer 3 may contain carbon C, nitrogen N or oxygen O as an impurity in order to elevate the specific resistivity. However, the excessive content of any of these elements will result in a decline in photosensitivity. It is also possible to dope photoconductive layer 3 with any element belonging to Group III or V of the periodic table. This process accelerates the transmission of a carrier such as a hole or electron. However, the excessive doping of any of the above-mentioned elements is not preferred, because the specific resistivity of said photoconductive layer 3 is reduced. The above-mentioned a - Si may contain microcrystalline silicon (μc - Si) or polycrystalline silicon.

Surface layer 4 is deposited on photoconductive layer 3. Surface layer 4 is prepared from boron nitride BN, and contains 10 to 200 atomic % of nitrogen N. If it is attempted to form surface layer 4 with a greater thickness than 0.1 micron, it is preferred to add more than 50 atomic % of nitrogen N. This process causes the optical band gap of surface layer 4 to raise above 3 eV. As a result, surface layer 4 does not absorb light rays having a broad range of wave-lengths from visible rays to ultraviolet rays, but allows for the permeation of these rays, thus elevating the photosensitivity of the photoconductive layer. Said surface layer 4 may contain 1 to 50 atomic % of hydrogen H or any of the halogen elements.

Description may now be made of the process of forming a layer involved in an electrophotographic photosensitive member embodying this invention. First, a conductive substrate is built in a chamber. The interior of the chamber in evacuated to an extent of $10^{-3}$ to $10^{-4}$ by means of a mechanical booster pump and oil rotated pump. The conductive support is held at a temperature of 100° to 400° C. Then introduced into the chamber are Si-containing gases such as $SiH_4$, $Si_2H_6$, $SiF_4$ and doping gases containing elements belonging to Group III or Group V of the periode table such as $B_2H_6$, $BF_3$, $PH_3$, as well as $N_2$ and $NH_3$. The evacuation speed of an evacuating system is controlled to evacuate the interior of the chamber to 0.1 to 10 torr. Later, high frequency power of 13.56 MHz is impressed between the electrodes to produce plasma, thereby forming the required layer in the conductive substrate.

Figure 2:
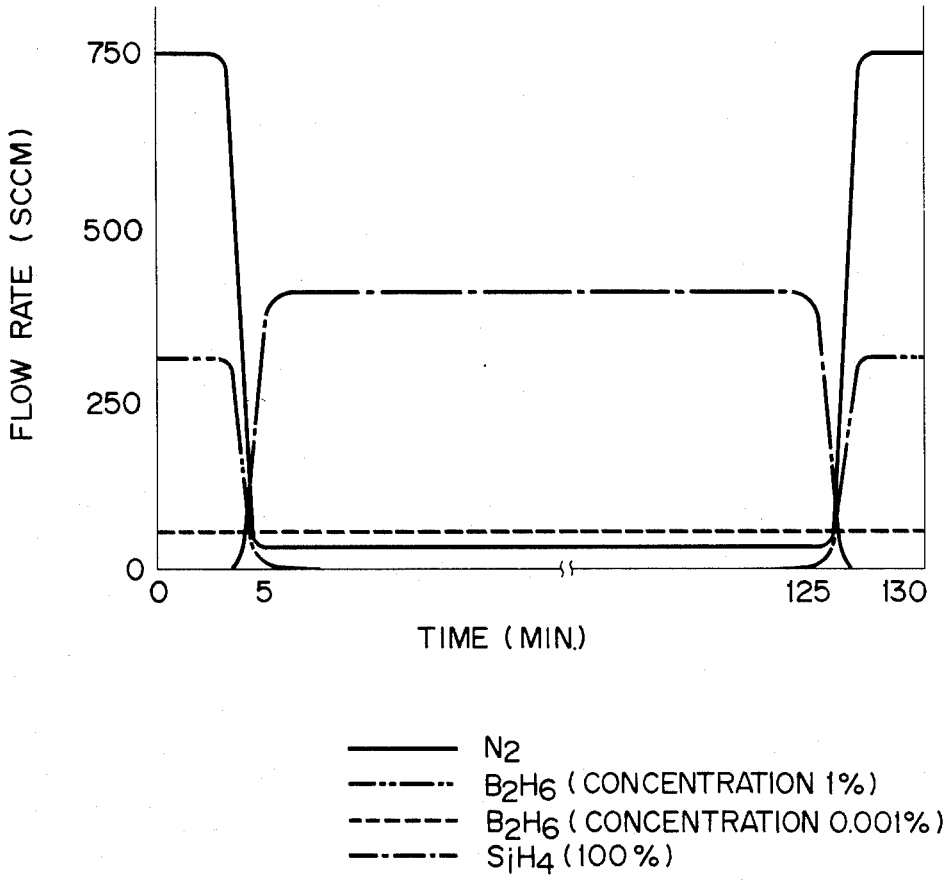
FIG. 2 graphically indicates the conditions in which the films involved in the subject electrophotographic photosensitive member are deposited.

The substrate are deposited under the following conditions. FIG. 2 graphically shows changes in the flow rate of gases taken into the chamber, with time shown on the abscissa and gas flow rate indicated on the ordinate. As measured on the helium base, $B_2H_6$ gas having a concentration of 1% is introduced into the chamber at the rate of 300 SCCM, $B_2H_6$ gas having a concentration of 0.001% is taken into the chamber at the rate of 50 SCCM and $N_2$ gas is carried into the chamber at the rate of 750 SCCM. The formation of layers was performed by applying the above-mentioned gases for 3 miniutes at the above defined flow rates. Thereafter, the content of $B_2H_6$ gas having a concentration of 1% and that of $N_2$ gas were gradually reduced until 8 minutes passed after the commencement of larger formation. Three minutes after the commencement of layer formation, $SiH_4$ gas was allowed to flow through the chamber. Eight minutes after the commencement of layer formation, the flow-rate of said $SiH_4$ gas fixed at 400 SCCM. Throughout the above-mentioned layer-forming process, a high-frequency power of 300 W was applied.

The flow rate of $SiH_4$ gas was reduced 125 minutes after the commencement of layer formation, and two minutes later, dropped to zero. During said 2-minute period, $N_2$ gas was increased through the chamber at a larger flow rate. At this time, $B_2H_6$ gas, having a concentration of 1%, began to flow. Two minutes later, $B_2H_6$ gas, having a concentration of 1%, was carried through the chamber at the flow rate of 300 SCCM and $N_2$ gas was passed through the chamber at the rate of 750 SCCM. The passage of the gasses was sustained for 3 minutes.

During the period of 3 minutes after the start of layer formation and also during the period of 3 minutes immediately before the termination of said layer formation, barrier layer 2 and surface layer 4, both prepared from BN were deposited. During 2 minutes before and after the deposition of said BN layers, another layer was formed in which the contents of boron B and nitrogen N continuously varied. In the foregoing example of the present invention, the layers formed in the above-mentioned 2-minute periods contain not only boron B, nitrogen N, and silicon Si but also hydrogen H. This step is taken for the reason given below. When $SiH_4$ gas is passed through the chamber, after $B_2H_6$ and $N_2$ gases are all completely drawn off, the gas content of the interior of the chamber is undesirably rarified for a few moments. In the foregoing example, boron-containing gas consisted of $B_2H_6$. However, replacement of $B_2H_6$ gas by $BF_3$ gas causes fluorine gas F to be taken in.

According to the present invention, the flow rates of raw gases are continuously varied as seen from FIG. 2. The results of analysis by the methods of ESCA or Auger also prove variations in the concentration of boron B or nitrogen N. The content of, for example, boron B detected by a method such as ESCA, represents the number of boron atoms in the unit volume. Continuous concentration changes occurring in the layer interface ensures the maintenance of the photoconductive property of the subject electrophotographic photosensitive member and prevents the exfoliation of the layers.

An electrophotographic photosensitive member embodying the present invention, whose layers were deposited under the above-mentioned condition, has the advantage that if an electric current running from a corona charger to an aluminum substrate has a magnitude of 0.4 $\mu c/cm^2$, then a surface potential of 800 V is obtained. This fact proves that the electrophotographic photosensitive member of the present invention increases over 20% in the charging capability above the conventional photosensitive member whose barrier layer is prepared from a - Si. The present invention further offers the advantages that 15 seconds after being charged, the subject photosensitive member indicates a charge retaining rate of 80%; when the surface potential of 600 V falls to half the original level, light irradiation stands at 0.3 lux.sec; the withstand voltage relative to development bias rises above 1500 V, proving that the photosensitive member embodying the present invention noticeably increases in withstand voltage (although in the conventional product involving the barrier layer of a - Si, dielectric breakdown occurred at about 200 volts); and even after over 2 million sheets were processed, a good image could be produced, proving that the photosensitive member embodying the present invention has a long effective life.

In the foregoing example, variations in the concentration of boron B in the boundary between the barrier layer and photoconductive layer and/or the boundary between the photoconductive layer and surface layer suppresses the exfoliation of the layer, thus insuring the maintenance of the photoconductive property of the subject photosensitive member. However, as viewed from the fundamental object of the present invention, it is not always necessary to vary the concentration of boron B.

Further, the layer-forming process may be performed not only by the plasma discharge process applied in the embodiment of the present invention, but also by the various methods such as thermal CVD, sputtering and ion plating.

What is claimed is:

1. An electrophotographic photosensitive member comprising:

a substrate;

a photoconductive layer comprising boron-containing amophous silicon;

a barrier layer, provided between said substrate and said photoconductive layer, for substantially inhibiting injection of carriers from said substrate to said photoconductive layer and;

a covering layer provided on said photoconductive layer, said barrier layer and said covering layer consisting essentially of boron nitride.

2. The member according to claim 1 wherein said barrier layer contains 10 to 100 atomic % of nitrogen.

3. The member according to claim 2, wherein said barrier layer contains 1 to 50 atomic % of an element selected from the group consisting of hydrogen and halogen element.

4. The member according to claim 3, wherein said barrier layer has a thickness of 50 Å to 5 microns.

5. The member according to claim 1, wherein said photoconductive layer contains at least one element selected from the group consisting of carbon, nitrogen and oxygen.

6. The member according to claim 1, wherein said photoconductive layer is doped with an element selected from the group consisting of elements belonging to Group III or V of the periodic table.

7. The member according to claim 1, wherein said surface layer contains 10 to 200 atomic % of nitrogen.

8. The member according to claim 7, wherein said covering layer has a thickness of 0.1 micron or more, and the content of nitrogen is 50 atomic % or more.

9. The member according to claim 8, wherein said covering layer contains 1 to 50 atomic % of an element selected from the group consisting of hydrogen and halogen element.

10. An electrophotographic photosensitive member which comprises:

a substrate;

a photoconductive layer comprising amorphous silicon;

a barrier layer consisting essentially of boron nitride and provided between said conductive substrate and photoconductive layer, the concentration of boron varying near the boundary between said barrier layer and photoconductive layer in the direction normal to said barrier layer; and a covering layer consisting essentially of boron nitride and provided on said photoconductive layer, the concentration of boron varying near the boundary between said covering layer and photoconductive layer in the direction normal to said surface layer.

11. The member according to claim 10, wherein said barrier layer contains 10 to 100 atomic % of nitrogen.

12. The member according to claim 11, wherein said barrier layer contains 1 to 50 atomic % of an element selected from the group consisting of hydrogen and halogen elements.

13. The member according to claim 12, wherein said barrier layer has a thickness of 50 Å to 5 microns.

14. The member according to claim 10, wherein said photoconductive layer contains at least one element selected from the group consisting of carbon, nitrogen and oxygen.

15. The member according to claim 10, wherein said photoconductive layer is doped with an element selected from the group consisting of elements belonging to Group III or V of the periodic table.

16. The member according to claim 10, wherein said covering layer contains 10 to 200 atomic % of nitrogen.

17. The member according to claim 16, wherein said covering layer has a thickness of 0.1 micron or more, and the content of nitrogen is 50 atomic % or more.

18. The member according to claim 17, wherein said surface layer contains 1 to 50 atomic % of an element selected from the group consisting of hydrogen and halogen elements.

* * * * *